US011969135B2

(12) United States Patent
Lubbers et al.

(10) Patent No.: US 11,969,135 B2
(45) Date of Patent: Apr. 30, 2024

(54) WET AND DRY VACUUM CLEANER

(71) Applicant: KONINKLIJKE PHILIPS N.V., Eindhoven (NL)

(72) Inventors: Matthijs Hendrikus Lubbers, Eindhoven (NL); Bernardus Lubbertus Kuiper, Eindhoven (NL)

(73) Assignee: VERSUNI HOLDING B.V., Eindhoven (NL)

( * ) Notice: Subject to any disclaimer, the term of this patent is extended or adjusted under 35 U.S.C. 154(b) by 0 days.

(21) Appl. No.: 17/607,068

(22) PCT Filed: Dec. 17, 2020

(86) PCT No.: PCT/EP2020/086788
§ 371 (c)(1),
(2) Date: Oct. 28, 2021

(87) PCT Pub. No.: WO2021/130103
PCT Pub. Date: Jul. 1, 2021

(65) Prior Publication Data

US 2022/0346610 A1 Nov. 3, 2022

(30) Foreign Application Priority Data

Dec. 23, 2019 (EP) ..... 19219193

(51) Int. Cl.
*A47L 7/00* (2006.01)
*A47L 5/28* (2006.01)
(Continued)

(52) U.S. Cl.
CPC ..... *A47L 7/0023* (2013.01); *A47L 5/28* (2013.01); *A47L 7/0009* (2013.01); *A47L 9/02* (2013.01);
(Continued)

(58) Field of Classification Search
CPC ..... A47L 7/0023; A47L 5/28; A47L 7/0009; A47L 9/02; A47L 9/1683
See application file for complete search history.

(56) References Cited

U.S. PATENT DOCUMENTS 3,079,626 A * 3/1963 Yonkers ..... A47L 11/4016 15/328
5,210,902 A * 5/1993 Lee ..... A47L 7/0009 15/322
(Continued)

FOREIGN PATENT DOCUMENTS

CA 2915197 A1 6/2016
CN 104323741 A 2/2015
(Continued)

OTHER PUBLICATIONS

JP 2004351191 A—English Machine Translation (Year: 2004).*
(Continued)

*Primary Examiner* — Marc Carlson
(74) *Attorney, Agent, or Firm* — Maschoff Brennan

(57) ABSTRACT

A cordless wet and dry stick vacuum cleaner system has a portable power module, which includes an airflow generator, a battery, and control circuitry. This may be used with either a wet dirt management system and a wet vacuum nozzle or it may be used with a dry dirt management system and a dry vacuum nozzle. The shared power module enables power savings, whereas the other parts remain optimized for their specific function.

18 Claims, 8 Drawing Sheets

(51) Int. Cl.

| | |
|---|---|
| ***A47L 9/02*** | (2006.01) |
| ***A47L 9/16*** | (2006.01) |
| ***A47L 9/22*** | (2006.01) |
| ***A47L 9/28*** | (2006.01) |
| ***A47L 9/32*** | (2006.01) |

(52) U.S. Cl.

CPC ..... *A47L 9/1683* (2013.01); *A47L 9/22* (2013.01); *A47L 9/2805* (2013.01); *A47L 9/2842* (2013.01); *A47L 9/2857* (2013.01); *A47L 9/2884* (2013.01); *A47L 9/325* (2013.01)

(56) References Cited

U.S. PATENT DOCUMENTS

| | | | | | |
|---|---|---|---|---|---|
| 5,735,017 | A * | 4/1998 | Barnes | A47L 11/4027 | 15/328 |
| 2008/0189901 | A1* | 8/2008 | Jansen | A47L 9/06 | 15/331 |
| 2014/0101887 | A1* | 4/2014 | Reed | A47L 9/2889 | 15/300.1 |
| 2017/0196426 | A1* | 7/2017 | Brown | A47L 5/24 | |
| 2019/0082906 | A1* | 3/2019 | Conrad | A47L 11/4013 | |

FOREIGN PATENT DOCUMENTS

| | | | | | |
|---|---|---|---|---|---|
| CN | 109846419 | A | * | 6/2019 | |
| DE | 1703220 | A1 | | 3/1972 | |
| EP | 0245873 | A1 | | 11/1987 | |
| EP | 0883368 | B1 | | 1/2000 | |
| JP | S36-4289 | B | | 4/1961 | |
| JP | S38-15316 | Y | | 7/1963 | |
| JP | S52-20669 | A | | 2/1977 | |
| JP | 2001-327444 | A | | 11/2001 | |
| JP | 2001327444 | A | * | 11/2001 | |
| JP | 2004-188216 | A | | 7/2004 | |
| JP | 2004188216 | A | * | 7/2004 | |
| JP | 2004-351191 | A | | 12/2004 | |
| JP | 2004351191 | A | * | 12/2004 | A47L 11/30 |
| JP | 2014-094026 | A | | 5/2014 | |
| JP | 2021-078532 | A | | 5/2021 | |
| RU | 2328201 | C2 | | 7/2008 | |
| WO | 2017177318 | A1 | | 10/2017 | |

OTHER PUBLICATIONS

Extended European Search Report issued in connection with corresponding EP Application No. 19219193.0 dated Jun. 16, 2020.

International Search Report and Written Opinion issued in connection with corresponding PCT Application No. PCT/EP2020/086788 dated Mar. 30, 2021.

* cited by examiner

WET AND DRY VACUUM CLEANER

CROSS-REFERENCE TO RELATED APPLICATIONS

The present application is a U.S. National Phase application under 35 U.S.C. § 371 of International Application No. PCT/EP2020/086788, filed on Dec. 17, 2020, which claims the benefit of European Patent Application No. 19219193.0, filed on Dec. 23, 2019. These applications are hereby incorporated by reference herein.

FIELD OF THE INVENTION

This invention relates to wet and dry vacuum cleaners.

BACKGROUND OF THE INVENTION

Traditionally, hard floor cleaning has involved first vacuuming the floor, followed by mopping it. The vacuuming removes the coarse dirt, while mopping removes any stains and fine dirt.

There are now many commercially available appliances that claim to vacuum and mop in one go, and this is what is referred to by a "wet vacuum cleaner". Many of these appliances have a vacuum nozzle for picking up the coarse dirt by means of an airflow and a (wet) cloth or brush for removing the stains. These wet cloths or brushes can be pre wetted or can be wetted by the consumer. In some cases, they can be wetted by the appliance (by means of a liquid but also by means of steam).

The wet vacuum cleaner then needs to be able to collect moist dirt from the floor in a dirt container. This is achieved using the airflow generated by a motor and fan arrangement. The moist dirt and other moisture needs to be separated from the airflow which then passes through the fan. The moist dirt and other moisture enters enter the dirt container whereas the remaining airflow passes through the fan and any post-filtering units, and then exits the appliance.

Separating moisture and moist dirt from an initial flow is a different task to separating dirt from a dry airflow. Moisture and moist dirt are in general separated by labyrinth filters, in which the dirt and moisture is make to strike walls and then tickle down into the dirt container. Wet dirt can also be separated by a cyclonic effect.

Dry dirt is in general separated by a cyclonic effect and/or by physical filtration.

In general, a wet vacuum cleaner is not best suited for a dry vacuuming function. There are too many trade-offs made in the design of the appliance that the usage for dry vacuuming is hampered and therefore the user still needs a dedicated dry vacuum cleaner.

Thus, wet and dry vacuum cleaners are generally optimized for their specific usage. The labyrinths in a wet vacuum cleaner will create too much resistance to have sufficient airflow for a high level of dry dirt pick up. A cyclone design which is optimal for wet dirt will also be different to a cyclone design which is optimal for dry dirt. In a dry vacuum cleaner, moisture will damage the filters and result in growth of mold if used for a long time.

Another issue is that when an appliance is used for both wet and dry cleaning, a caking layer will "grow" inside the appliance. The moistened walls of the appliance become covered by a thin layer of dry dust which then creates a very hard coating which is difficult to remove. This layer will grow during usage and eventually ruin the appliance.

There is an increasing popularity of battery operated cordless vacuum cleaners. These present additional design difficulties, for example they should be light weight. This poses a challenge when attempting to device a vacuum cleaner system that can perform the tasks of both wet and dry vacuum cleaning.

There is a need for a system which can perform both wet and dry vacuum cleaning to avoid the cost of separate devices, but without compromising the ability of the system to perform each task.

SUMMARY OF THE INVENTION

The invention is defined by the claims.

According to examples in accordance with an aspect of the invention, there is provided a cordless wet and dry stick vacuum cleaner system, comprising:

- a portable power module comprising an airflow generator, a battery and control circuitry;
- a first dirt management system for processing a wet vacuumed flow and separating and collecting the vacuumed liquid, wherein the first dirt management system is for attachment to the portable power module, wherein the portable power module delivers suction for the first dirt management system;
- a first, wet, vacuum nozzle for attachment to the first dirt management system;
- a second dirt management system for processing a dry vacuumed flow and collecting the vacuumed dirt, wherein the second dirt management system is for attachment to the portable power module, wherein the portable power module delivers suction for the second dirt management system; and
- a second, dry, vacuum nozzle for attachment to the second dirt management system.

The term "stick vacuum cleaner" refers to a vacuum cleaner in which, in use, the attached vacuum nozzle (i.e. the first or second vacuum nozzle) forms the only contact with the surface to be vacuumed. Furthermore, the vacuum cleaner is not self-supporting, i.e. the weight of the handle end of the vacuum cleaner is supported by the user. The vacuum cleaner is intended for floors but also other attachments may be used which are directly connected to the same location as the vacuum nozzle (rather than to a separate hose). The vacuum cleaner may then be for use with the weight fully supported by the user, for example for vacuuming ceilings, the tops of skirting board, inside vehicles etc. Thus, typically the weight of a stick vacuum cleaner is below 5 kg, for example below 4 kg (when empty).

The system of the invention enables the main costly parts of the vacuum cleaner, most notably the battery (power source) and suction fan (airflow generator), to be shared between the two cleaning modes; wet and dry. It is known that different appliances can make use of a shared battery pack. The invention enables additional components to be shared. For both wet and dry floor cleaning appliances, the main components are the airflow generator and the power source as mentioned above, but also the user interface and main electronics (including battery management). These components are also the strongest drivers for costs.

The invention combines these components into a portable power module for use in both wet and dry modes, and therefore reduces cost significantly. However, all parts downstream of the portable power module are designed for their respective purpose. This optimizes the performance in each mode, while avoiding excessive weight of the system by having many components that are not needed in each particular mode. In this way, the weight can be reduced so that a stick type configuration is enabled in both wet and dry modes (with the portable power module raised above the floor surface and with only the nozzle (or a dirty air inlet) making contact with the floor).

The main filtering and collection of wet or dry debris is performed upstream of the portable power module, which functions primarily as the source of suction. However, downstream of the motor there may be an additional filter for fine dust collection, for example a filter foam, a pleated filter or a HEPA grade filter. This downstream filter for example filters carbon dust from the brush motor.

The wet vacuum nozzle is designed to wet the floor and to pick up wet dirt. There may be multiple types of dry vacuum nozzle such as a hard floor nozzle for hard floor coverings including stone and wood among others and a soft floor nozzle for soft floor coverings such as carpet.

The dry nozzle may instead be a hybrid nozzle that can switch between soft and hard floors or a hybrid nozzle that can function for both floor types without switching. A soft floor dry nozzle may include an agitator or brush to flick the piles of carpets to dislodge the dirt from within and make it airborne so that it can be caught by the vacuum stream. This brush or agitator may be driven mechanically by the airflow or it may be driven by an electric motor, in which case power is provided to the nozzle from the portable power module.

The first dirt management system preferably comprises a clean water reservoir and a waste water reservoir.

The clean water is used to wet the floor, and optionally also a brush of the wet vacuum nozzle. Dirty water can be collected directly in a separator of the first dirt management system (which then functions as the waste water reservoir) or the dirty water can be routed to a separate waste water reservoir.

The first dirt management system may comprise a gravity feed system for delivering water to the first vacuum nozzle. There may be a manually foot operated pump by which the user can choose to add more water.

Alternatively, the first dirt management system may comprise a pump for delivering water to the first vacuum nozzle, wherein the pump uses power coupled from the portable power module. Thus, there may be forced delivery of water to the surface to be vacuumed.

The first dirt management system may comprises a water heater and a pump for delivering steam to the first vacuum nozzle, wherein the pump and heater use power coupled from the portable power module. Thus, the wet vacuum function may involve use of steam for steam cleaning.

The first and/or second vacuum nozzles may be powered, using power coupled from the portable power module. This power may be used for driving rotary components such as brushes, or for heating or for pumping, as mentioned above.

The airflow generator for example comprises a motor and a fan driven by the motor, wherein the motor comprises a bypass motor. This type of motor can tolerate water content in the air flow, because the drawn in air flow is not used for motor cooling and is isolated from the motor parts. Instead, ambient air is drawn in to the motor for cooling purposes using a separate air flow path. A separate small fan may be used for driving this cooling air flow.

The portable power module may comprise an input unit or an identifying unit, for identifying the attached dirt management system, and the control circuitry is for controlling the airflow generator in dependence on the identified attached dirt management system.

Thus, the portable power module may recognize the dirt management system or a user may make a mode selection which relates to the type of dirt management system being used, so that the portable power module can deliver an appropriate suction flow.

The portable power module may comprise an input unit or an identifying unit, for identifying the attached vacuum nozzle, and the control circuitry is for controlling the airflow generator in dependence on the identified attached vacuum nozzle.

Thus, the portable power module may recognize the nozzle or a user may make a mode selection which relates to the type of nozzle being used, so that the portable power module can deliver an appropriate suction flow. The control circuitry may comprise one or more microcontrollers as well as various other electrical components.

The vacuum cleaner system preferably further comprises a handle, wherein the portable power module and/or the dirt management system is mountable at different positions between the handle and the first or second vacuum nozzle.

In this way, the weight distribution can be altered (i.e. how close to the handle the heavy parts are positioned) according to the desired configuration.

For example, in one configuration the first dirt management system may be mounted adjacent the first vacuum nozzle. Thus, the greater weight of the first, wet dirt management system (compared to the second, dry dirt management system) is kept close to the ground, which makes use of the device easier for wet vacuuming and mopping of a floor.

In another configuration, the second dirt management system and the portable power module may be mounted adjacent the handle with a shaft between the second dirt management system and the second vacuum nozzle.

Thus, the weight of the second dirt management system is kept close to the handle, which makes use of the device easier when lifted off the ground and being swung.

The portable power module for example comprises a user interface for allowing a user to select a wet mode or a dry mode. Thus, the user interface is also shared between the modes and it allows the user to select the wet mode or the dry mode.

The control circuitry may for example be adapted to control the user interface automatically in dependence on the attached dirt management system and/or vacuum nozzle. The user interface for example comprises a display for displaying information relating to a selected wet mode or dry mode.

The invention along with various embodiments discussed above is explained in conjunction with a first, wet, vacuum nozzle, which is suitable for being attached to a first dirt management system. It may be noted that such an attachment between the first dirt management system and the first, wet, vacuum nozzle may be performed by a user while/at the time of operating the vacuum cleaner or such an attachment between the two can alternatively be pre-performed by the manufacturer himself and thus providing the first dirt management system and the first, wet, vacuum nozzle as a single piece, which is then suitable to be attached to a portable power module. The same reasoning applies for a second dirt management system and a second, dry, vacuum nozzle.

These and other aspects of the invention will be apparent from and elucidated with reference to the embodiment(s) described hereinafter.

BRIEF DESCRIPTION OF THE DRAWINGS

For a better understanding of the invention, and to show more clearly how it may be carried into effect, reference will now be made, by way of example only, to the accompanying drawings, in which.

DETAILED DESCRIPTION OF THE EMBODIMENTS

Figure 1:
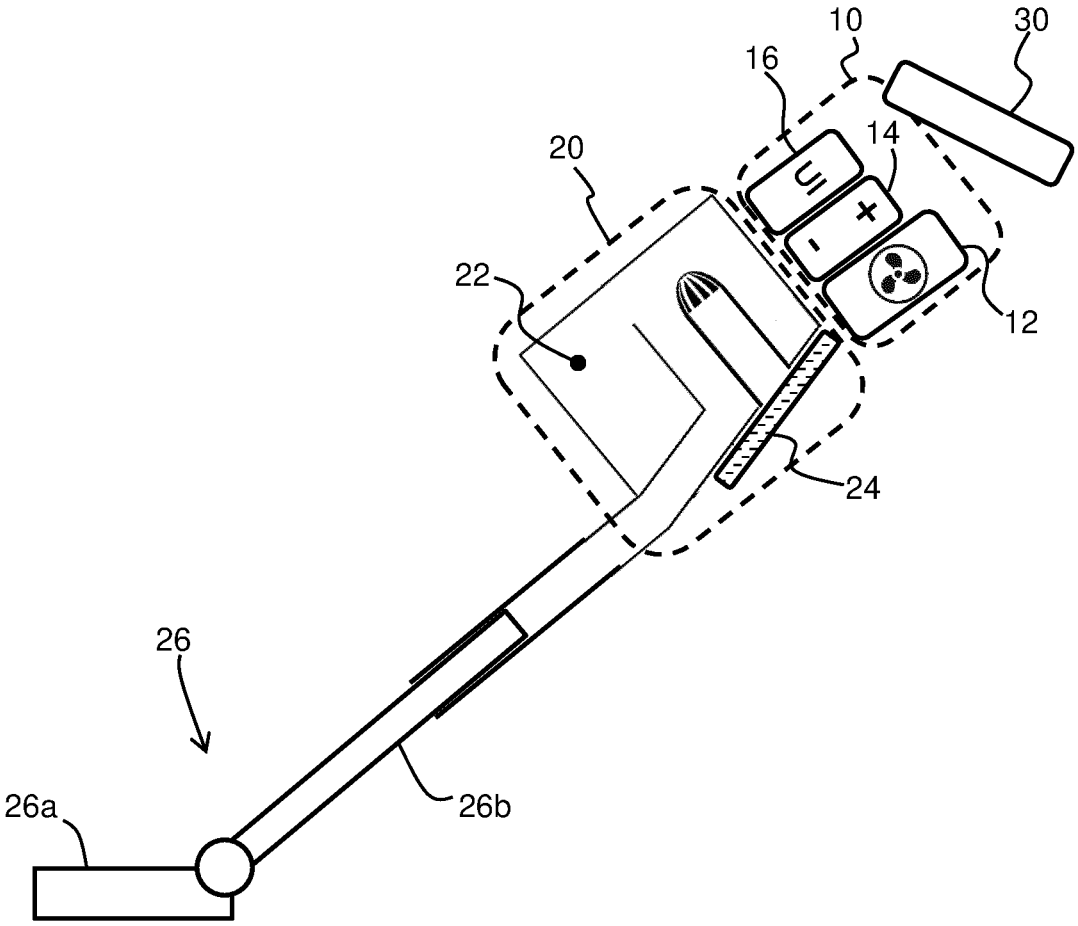
FIG. 1 shows a first example of a wet and dry vacuum cleaning system in a first configuration.

The invention will be described with reference to the Figures.

It should be understood that the detailed description and specific examples, while indicating exemplary embodiments of the apparatus, systems and methods, are intended for purposes of illustration only and are not intended to limit the scope of the invention. These and other features, aspects, and advantages of the apparatus, systems and methods of the present invention will become better understood from the following description, appended claims, and accompanying drawings. It should be understood that the Figures are merely schematic and are not drawn to scale. It should also be understood that the same reference numerals are used throughout the Figures to indicate the same or similar parts.

The invention provides a cordless wet and dry stick vacuum cleaner system which has a portable power module comprising an airflow generator, a battery and control circuitry. This may be used with either a wet dirt management system and a wet vacuum nozzle or it may be used with a dry dirt management system and dry vacuum nozzle. The shared power module enables power savings, whereas the other parts remain optimized for their specific function.

FIG. 1 shows a first example of the system in a first configuration. FIG. 1 shows a dry vacuum cleaner, which has been configured from a sub-set of the components of a wet and dry stick vacuum cleaner system.

The shown configuration comprises a portable power module 10 comprising an airflow generator 12, a battery 14 and control circuitry 16.

The airflow generator 12 for example comprises a motor and a fan driven by the motor. The motor is for example a bypass motor. This type of motor can tolerate water content in the air flow, because the drawn in air flow is not used for motor cooling and is isolated from the motor parts. Instead, ambient air is drawn in to the motor for cooling purposes.

The configuration shown in FIG. 1 makes use of a dry dirt management system 20 for processing a dry vacuumed flow and collecting the vacuumed dirt. The dry dirt management system is for attachment to the portable power module 10. The airflow generator 12 delivers suction for the dry dirt management system 20. A dry vacuum nozzle 26 is for attachment to the dry dirt management system.

The dry dirt management system 20 in this example comprises a single cyclone having a dust collection volume 22. An outlet filter 24 is provided between the outlet flow of the cyclone and the air flow generator 12. The cyclone chamber extends along an axis which is perpendicular to the inlet flow direction. The inlet flow is supplied radially inwardly into a base of the cyclone chamber and the flow exits through the vortex finder at the top of the cyclone chamber. The dust collection volume 22 is located toward the nozzle from the cyclone chamber (i.e. underneath when the vacuum cleaner is upright) and hence laterally to the side of the cyclone chamber.

The portable power module 10 is separable from the dry dirt management system 20. In particular, there is an air flow passage from the outlet of the dry dirt management system 20 to the portable power module 10 so that the airflow generator of the portable power module draws air through the dry dirt management system 20.

The portable power module 10 may include an exhaust filter, not shown.

The dry vacuum nozzle 26 comprises a head **26*a* and a shaft 26*b*. They are both preferably separable from the dry dirt management system 20. In particular different head types may be fitted to the shaft 26*b***. For example, there may be a hard floor head type and a soft floor head type.

Furthermore, the heads (or other additional heads) may be attached directly to the dry dirt management system 20 for example for vacuuming in more compact locations such as in a vehicle or for shelves etc. Examples of other attachments to swap over with the head **26*a*** include a thin high suction nozzle, a staircase rotary brush nozzle, a brush, etc.

The dry vacuum nozzle may for example comprise a rotary brush driven by the air flow, or there could even be an electrically powered rotary brush.

There is a handle 30 at the opposite end of the vacuum cleaner to the head **26*a***.

In the configuration shown in FIG. 1, the dry dirt management system 20 and the portable power module are located adjacent the handle 30. The handle may be part of the portable power module, or it may instead be removably attached to the portable power module.

The vacuum cleaner is a stick vacuum cleaner so that in use the head **26*a* forms the only contact with the surface to be vacuumed. The vacuum cleaner is sufficiently light weight that a user can suspend or swing the head 26*a*** in the air to vacuum surfaces or objects which are not at ground level. The weight of the vacuum cleaner is for example below 5 kg, for example below 4 kg (when empty).

Figure 2:
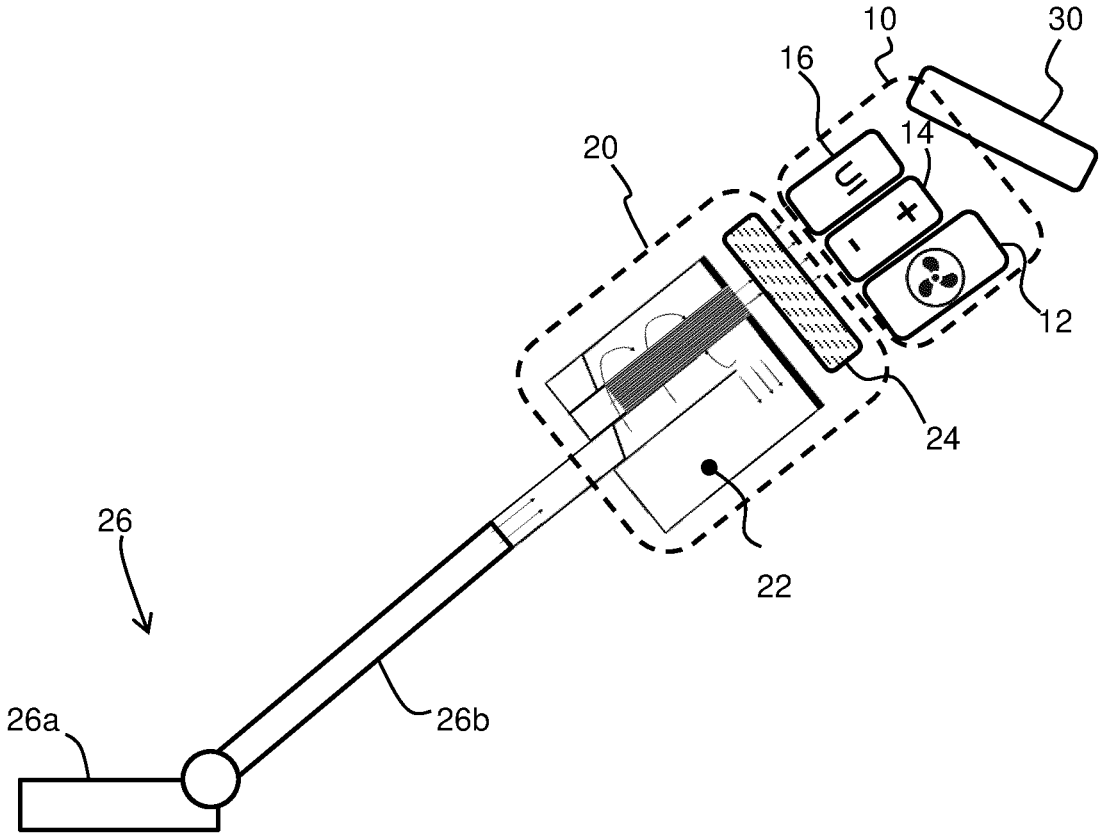
FIG. 2 shows a similar arrangement to FIG. 1 but with a different dry dirt management system.

FIG. 2 shows a similar arrangement to FIG. 1 but with a different dry dirt management system 20. It is again a single cyclone arrangement but with the cyclone chamber extending along an axis which is parallel to the inlet flow direction. The dust collection volume 22 is laterally to the side of the cyclone chamber. The inlet flow is supplied axially into a base of the cyclone chamber and the flow exits from the top of the chamber.

Figure 3:
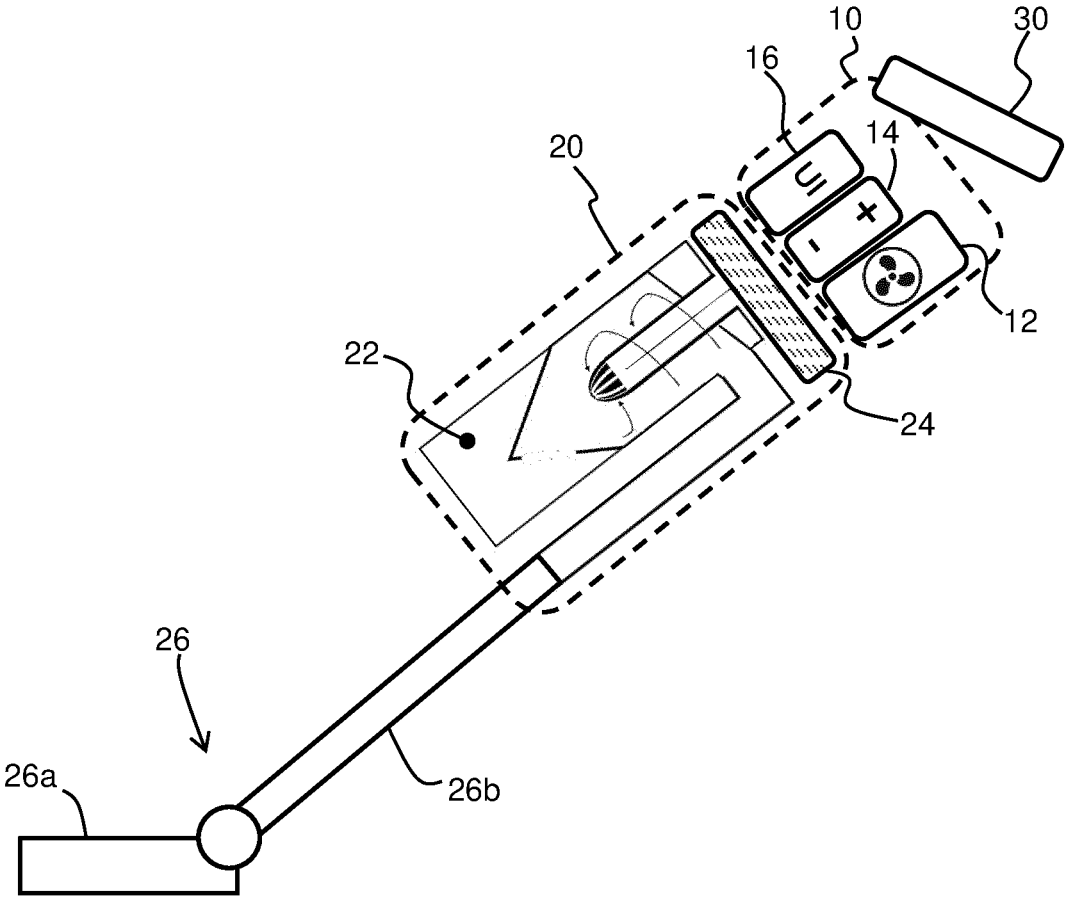
FIG. 3 shows a similar arrangement to FIG. 1 but with yet another different dry dirt management system.

FIG. 3 shows a similar arrangement to FIG. 1 but with yet another different dry dirt management system 20. It is again a single cyclone arrangement with the cyclone extending along an axis which is parallel to the inlet flow direction. The inlet flow is supplied axially along a path parallel with the axis of the cyclone chamber, and then radially inwardly into a base of the cyclone chamber. The flow exits through the vortex finder at the top of the cyclone chamber (note that the "top" is facing downwardly). The dust collection volume 22 is below the cyclone chamber (when the vacuum cleaner is upright).

Figure 4:
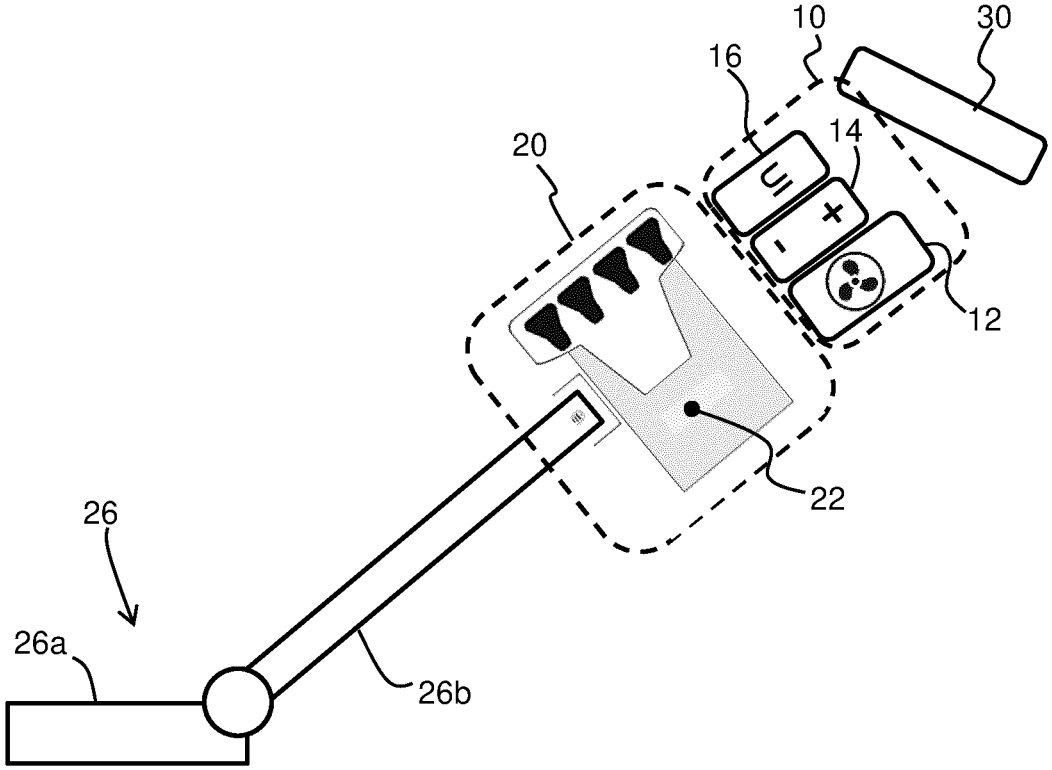
FIG. 4 shows a similar arrangement to FIG. 1 but with yet another different dry dirt management system.

FIG. 4 shows a similar arrangement to FIG. 1 but with yet another different dry dirt management system 20. It is a multi-cyclone arrangement over the top of the collection volume 22.

FIGS. 1 to 4 are described as dry vacuum cleaner arrangements. However, the cyclones may be designed specifically for wet use or for dry use. Thus, the same configurations may be applied to a wet vacuum cleaner. In such a case, the cyclone forms a wet dirt management system for processing a wet vacuumed flow and separating and collecting the vacuumed liquid. The cyclone is then typically combined with a labyrinth filter system to enable collection of water. Thus, the dust collection volume 22 is then for collecting separated water and moist dirt and it therefore functions as a waste water reservoir. Alternatively, dirty water can be routed to a separate waste water reservoir.

The user may be required to deliver water to the surface being vacuumed independently of the vacuum cleaner. However, the wet dirt management system may instead include a clean water reservoir for delivering water to a wet vacuum nozzle.

For a wet vacuum cleaner, a different nozzle is also used. A wet vacuum nozzle for example has a rotary brush to which water is delivered from the clean water reservoir, and hence also has an inlet for receiving water from the clean water reservoir. The wet vacuum nozzle is specifically designed to pick up wet dirt and optionally also perform the floor wetting.

The system of the invention is the combination of the shared part (the portable power module) and the separate parts (the wet dirt management system and wet nozzle, and the dry dirt management system and dry nozzle). However, the different parts may be sold separately so that a user can start with a dry system and upgrade later to a wet and dry system, for example.

The overall system enables the main costly parts of the vacuum cleaner, namely the battery 14 and suction fan 12 of the portable power module, to be shared between the two cleaning modes; wet and dry. All parts downstream of the portable power module 10 are designed for their respective purpose. This optimizes the performance in each mode, while avoiding excessive weight of the system by having many components that are not needed in each particular mode. In this way, the weight can be reduced so that a stick type configuration is enabled in both wet and dry modes.

Figure 5:
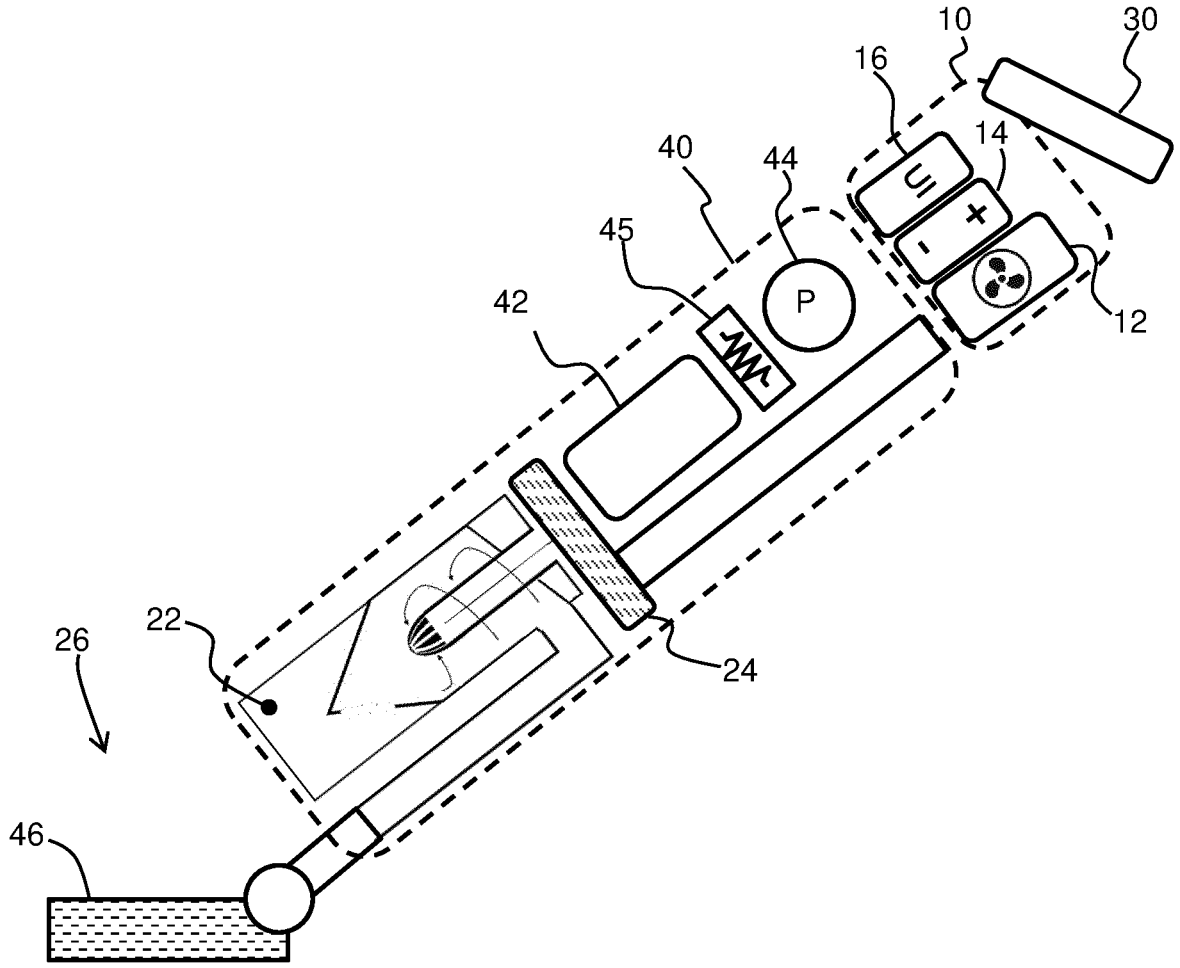
FIG. 5 shows a configuration of particular interest for a wet vacuum mode.

FIG. 5 shows a configuration of particular interest for a wet vacuum mode.

A wet dirt management system 40 is mounted near the bottom of the vacuum cleaner, and the wet vacuum nozzle 46 connects to the wet dirt management system 40. By making the center of gravity low, it is easier for a user to manipulate the vacuum cleaner, as more of the load is carried by the floor (through the vacuum nozzle) and less is carried by the user.

FIG. 5 shows a cyclone of the same type as FIG. 3—the additional labyrinth filter system is not shown.

FIG. 5 also shows a clean water reservoir 42 for delivering water to the wet vacuum nozzle 46.

The wet dirt management system 40 may comprise a gravity feed system for delivering water to the wet vacuum nozzle 46. There may be a manually foot operated pump by which the user can choose to add more water. Alternatively, the wet dirt management system may comprise a pump 44 for delivering water to the first vacuum nozzle, wherein the pump uses power coupled from the portable power module. Thus, there may be forced delivery of water to the surface to be vacuumed.

The wet dirt management system may also comprise a water heater 45 and the pump may then be for delivering steam to the wet vacuum nozzle 46.

Any electrically powered units in the wet dirt management system 40 use power from the battery 14 in the portable power module 10. There are therefore electrical connections made by coupling the portable power module 10 to the wet dirt management system 40.

The vacuum nozzles (wet and/or dry) may also be powered, again using power coupled from the portable power module. There are then also electrical connections made by coupling the respective nozzle to the respective dirt management system.

Figure 6:
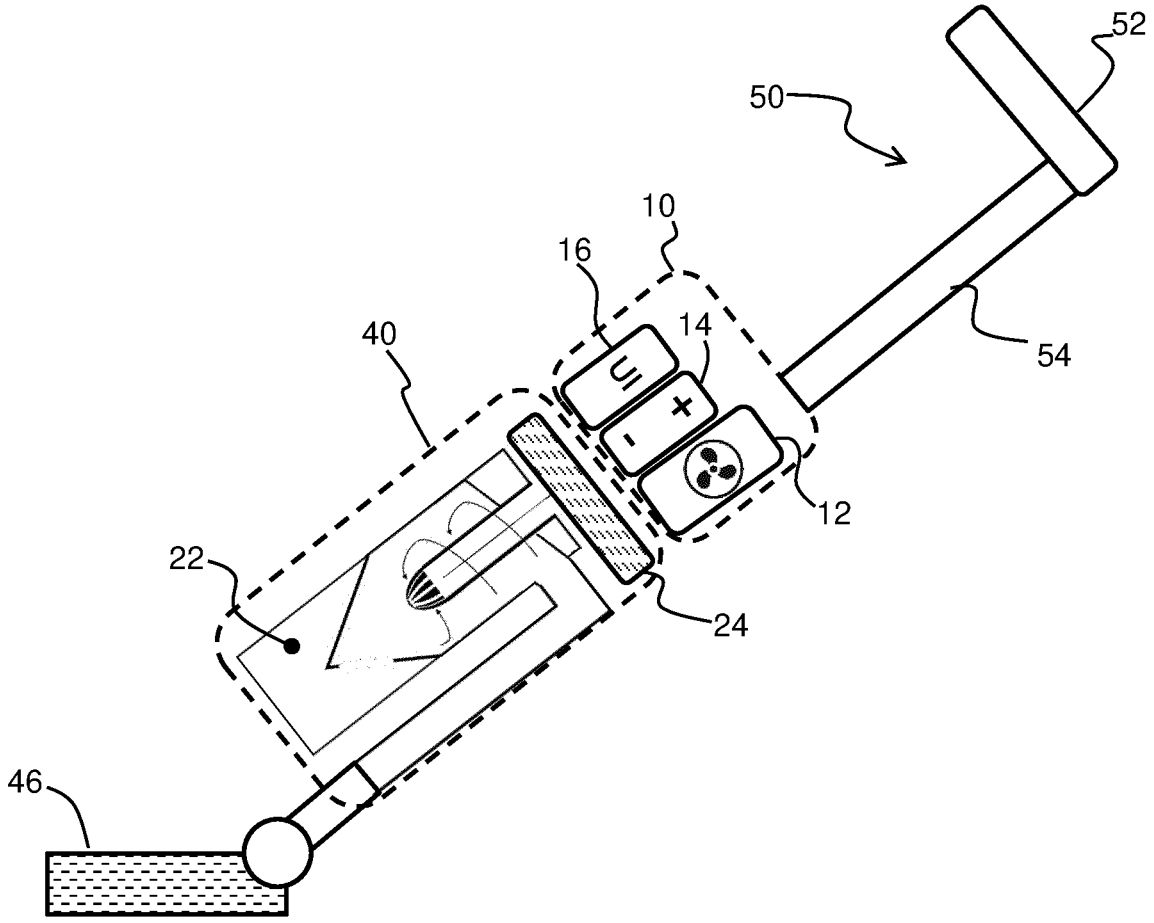
FIG. 6 shows another configuration of particular interest for a wet vacuum mode.

FIG. 6 shows another configuration which may be used for a wet configuration or for a dry configuration. It may be of particular interest for a wet vacuum mode (during which swinging of the vacuum cleaner in the air is not needed) because the weight is nearer to the floor.

As in FIG. 5, the wet dirt management system 40 is mounted near the bottom of the vacuum cleaner, and the wet vacuum nozzle 46 connects to the wet dirt management system 40. In addition, the portable power module 10 is located adjacent the wet dirt management system 40 and remote from the handle 50. Thus, the handle 50 is different to the handle 30 shown in FIGS. 1 to 5 and has a grip 52 and an extension 54. The handle is thus detachable from the portable power module 10 so that the grip of the handle may be proximate the portable power supply module (e.g. FIG. 3) or remote from it (FIG. 6). The handle 52 may be the same handle 30 so that only an extension piece 54 is needed to switch between handle modes.

The portable power module and/or the dirt management system are in this way mountable at different positions between a handle and the first or second vacuum nozzle.

Figure 7:
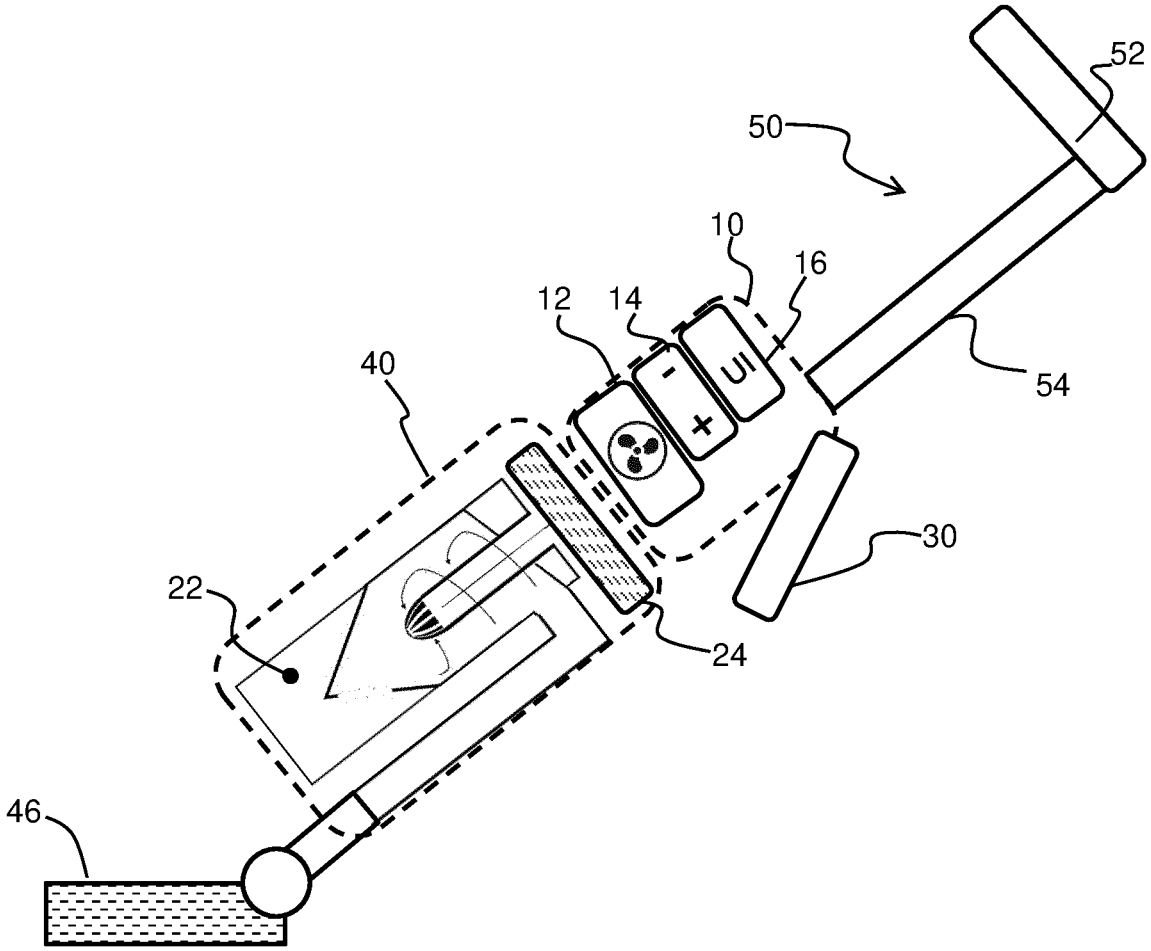
FIG. 7 shows a different handle configuration.

As shown in FIG. 7, the handle 30 may be an integral part of the portable power module, and the remote handle 50 is then attached as an extra item. The portable power module may connect to the dirt management system differently for different modes, as schematically shown in FIG. 7.

Figure 8:
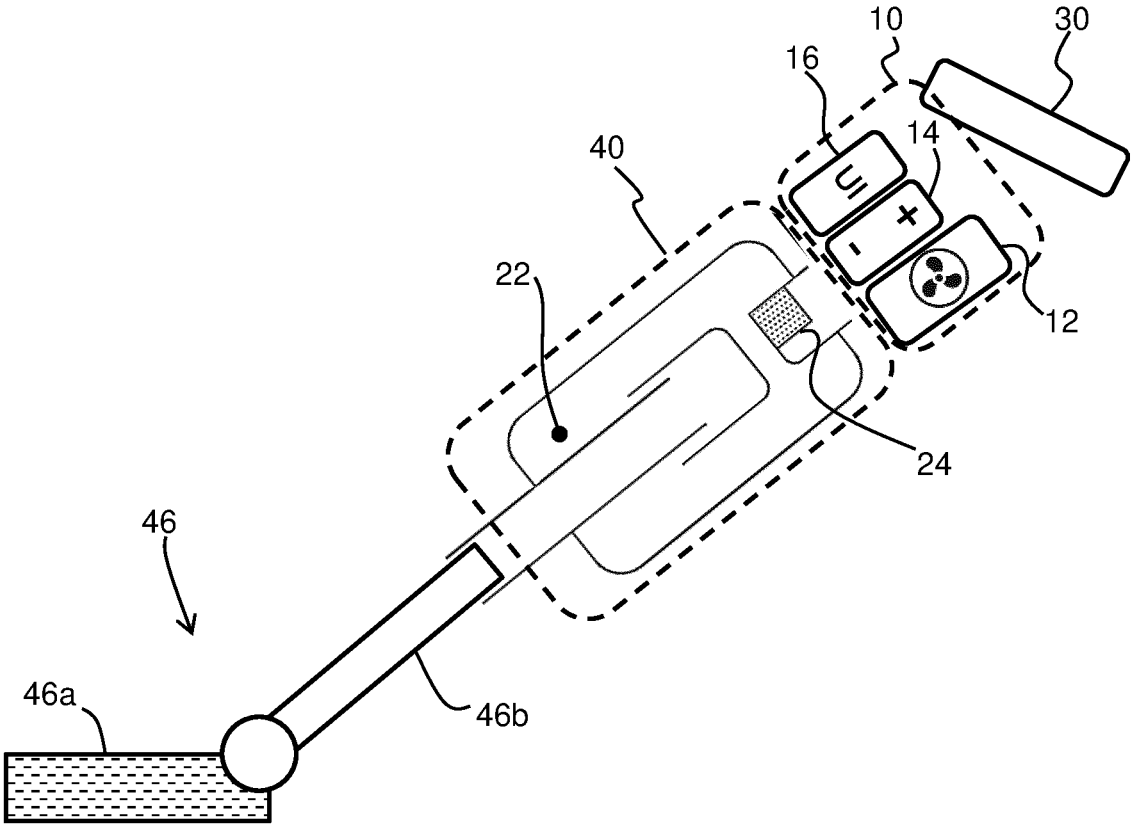
FIG. 8 shows another design of wet dirt management system.

FIG. 8 shows another design of wet dirt management system known as a "tube-in-cup" filter. Water is deposited on the inner surface of a cup, and it is collected under gravity in the collection volume 22.

The examples above show that many different cyclone designs or other filtering arrangements may be used.

The suction level required for different dirt management systems is typically different. Thus, the control circuitry of the portable power module 10 is preferably aware of the type of dirt management system that is connected so that appropriate control is implemented.

One approach is simply for the portable power module to have an input interface to allow a user to identify the dirt management system that is attached. The user can select a wet mode or a dry mode. Thus, the user interface is also shared between the modes. The portable power module may comprise a display for displaying information relating to a selected wet mode or dry mode. The airflow generator is then controlled in dependence on the identified attached dirt management system.

Alternatively, an identifying unit is provided for identifying automatically the attached dirt management system. This may be a mechanical switch which is closed when the two are coupled together, with different switches being closed by the compatible wet dirt management system and the compatible dry dirt management system. Alternatively, a more electronic solution may be adopted by which the portable power module communicates electronically with the attached dirt management system. This may make use of RF ID tags or any other electronic identification system.

The same may apply to the vacuum nozzle. In the case of an identifying unit for identifying the attached vacuum nozzle, there may be an electrical connection between the portable power module and the vacuum nozzle through the dirt management system. An electrical signal is then received by the portable power supply module, and it indicates the type of vacuum nozzle that has been attached.

It will be understood from the description above that the system has a portable power module to which, alternately, a wet and dry dirt management system and associated vacuum nozzle (and typically also the connecting tube to the nozzle) can be attached. In both modes, a stick type system is implemented (rather than an upright or canister configuration).

The control circuitry in the portable power module preferably implements all of the essential control functions, such as recognizing the attached parts and controlling the airflow to a suitable level. The air flow rate and/or fan power is typically different between the different modes. The control circuit also controls the user interface, for providing output information on a display or other output arrangement.

The wet dirt management system typically makes uses of a cyclonic separator as shown, but a labyrinth filter design for moisture separation may additionally or alternatively be used. Other approaches are possible such as moisture capturing filters.

The portable power supply module is for use in a potentially wet environment, so it will be designed with suitable ingress protection (IPX) such that contamination from external water, e.g. while the appliance is laid on a wet floor, is prevented.

There may be additional filters in the overall vacuum cleaner system to those shown. Filters in the portable power module or in the wet dirt management system are typically tolerant of a moisture content, whereas filters in the dry dirt management system do not need such tolerance.

Variations to the disclosed embodiments can be understood and effected by those skilled in the art in practicing the claimed invention, from a study of the drawings, the disclosure and the appended claims. In the claims, the word "comprising" does not exclude other elements or steps, and the indefinite article "a" or "an" does not exclude a plurality.

The mere fact that certain measures are recited in mutually different dependent claims does not indicate that a combination of these measures cannot be used to advantage.

If the term "adapted to" is used in the claims or description, it is noted the term "adapted to" is intended to be equivalent to the term "configured to".

Any reference signs in the claims should not be construed as limiting the scope.

The invention claimed is:

1. A cordless wet and dry stick vacuum cleaner system, comprising:

a portable power module comprising an airflow generator, a battery, control circuitry, and a user interface to enable user selection of a wet mode or a dry mode;

a first dirt management system for processing a wet vacuumed flow and separating and collecting vacuumed liquid, wherein the first dirt management system is for attachment to the portable power module, and wherein the portable power module delivers suction for the first dirt management system;

a first, wet, vacuum nozzle for attachment to the first dirt management system;

a second dirt management system for processing a dry vacuumed flow and collecting vacuumed dirt, wherein the second dirt management system is for attachment to the portable power module, and wherein the portable power module delivers suction for the second dirt management system; and a second, dry, vacuum nozzle for attachment to the second dirt management system.

2. The vacuum cleaner system of claim 1, wherein the first dirt management system comprises a clean water reservoir.

3. The vacuum cleaner system of claim 2, wherein the first dirt management system further comprises a waste water reservoir.

4. The vacuum cleaner system of claim 3, wherein the first dirt management system further comprises a gravity feed system for delivering water to the first vacuum nozzle.

5. The vacuum cleaner system of claim 3, wherein the first dirt management system further comprises a pump for delivering water to the first vacuum nozzle, and wherein the pump uses power coupled from the portable power module.

6. The vacuum cleaner system of claim 3, wherein the first dirt management system further comprises a water heater and a pump for delivering steam to the first vacuum nozzle, and wherein the pump and the water heater use power coupled from the portable power module.

7. The vacuum cleaner system of claim 1, wherein the first or second vacuum nozzles are electrically powered, using power coupled from the portable power module.

8. The vacuum cleaner system of claim 1, wherein the airflow generator comprises a motor and a fan driven by the motor, and wherein the motor comprises a bypass motor.

9. The vacuum cleaner system of claim 1, wherein the portable power module further comprises:

an input unit for receiving an identification of the attached first or second dirt management system and/or the attached first or second vacuum nozzle; or an identifying unit for identifying the attached first or second dirt management system and/or the attached first or second vacuum nozzle, wherein the control circuitry is for controlling the airflow generator in dependence on the identified attached first or second dirt management system and/or the attached first or second vacuum nozzle.

10. The vacuum cleaner system of claim 1, further comprising a handle, wherein the portable power module and/or the first or second dirt management system is mountable at different positions between the handle and the first or second vacuum nozzle.

11. The vacuum cleaner system of claim 10, wherein, in one configuration, the first dirt management system is mounted adjacent the first vacuum nozzle.

12. The vacuum cleaner system of claim 10, wherein, in one configuration, the second dirt management system and the portable power module are mounted adjacent the handle with a shaft between the second dirt management system and the second vacuum nozzle.

13. The vacuum cleaner system of claim 10, wherein the second vacuum nozzle comprises a head and a shaft.

14. The vacuum cleaner system of claim 13, wherein the handle is mounted at an opposite end of the vacuum cleaner system to the head of the second vacuum nozzle.

15. The vacuum cleaner system of claim 1, wherein the control circuitry is adapted to control the user interface automatically in dependence on the attached first or second dirt management system and/or the attached first or second vacuum nozzle.

16. The vacuum cleaner system of claim 1, wherein the portable power module further comprises a display for displaying information relating to the selected wet mode or dry mode.

17. The vacuum cleaner system of claim 1, wherein the first dirt management system and the first, wet, vacuum nozzle are separate pieces, and wherein the second dirt management system and the second, dry, vacuum nozzle are separate pieces.

18. The vacuum cleaner system of claim 1, wherein the first dirt management system and the first, wet, vacuum nozzle is a single piece suitable to be attached to the portable power module, and wherein the second dirt management system and the second, dry, vacuum nozzle is a single piece suitable to be attached to the portable power module.

* * * * *